US007716958B2

(12) United States Patent
Martin

(10) Patent No.: US 7,716,958 B2
(45) Date of Patent: May 18, 2010

(54) INSERT CYLINDER CABINET CAM LOCK

(75) Inventor: Frank J. Martin, Edmonds, WA (US)

(73) Assignee: Olympus Lock, Inc., Lynnwood, WA (US)

( * ) Notice: Subject to any disclaimer, the term of this patent is extended or adjusted under 35 U.S.C. 154(b) by 364 days.

(21) Appl. No.: 11/811,262

(22) Filed: Jun. 7, 2007

(65) Prior Publication Data

US 2008/0302145 A1 Dec. 11, 2008

(51) Int. Cl.
*E05B 65/44* (2006.01)

(52) U.S. Cl. ..... 70/78; 70/373; 70/375; 70/367; 70/370; 70/371

(58) Field of Classification Search ..... 70/78–81, 70/373, 375, 367–371, 451
See application file for complete search history.

(56) References Cited

U.S. PATENT DOCUMENTS 3,789,638 A * 2/1974 Roberts et al. ..... 70/366
4,099,397 A * 7/1978 Dauenbaugh ..... 70/371
4,369,642 A * 1/1983 Grell ..... 70/389
4,899,563 A 2/1990 Martin
4,920,774 A * 5/1990 Martin ..... 70/367
5,038,589 A 8/1991 Martin
5,265,453 A * 11/1993 Konii et al. ..... 70/379 R
5,325,690 A * 7/1994 Adler et al. ..... 70/383
5,657,652 A 8/1997 Martin
5,685,184 A * 11/1997 Gallagher ..... 70/358
5,737,950 A 4/1998 Yun-Bin
5,884,512 A * 3/1999 Wayne ..... 70/370
6,920,770 B2 * 7/2005 Lurie et al. ..... 70/100
6,948,345 B1 * 9/2005 Ruan ..... 70/370
2005/0011239 A1 * 1/2005 Lurie et al. ..... 70/369
2007/0227209 A1 * 10/2007 Massard et al. ..... 70/371

* cited by examiner

*Primary Examiner*—Suzanne D Barrett
(74) *Attorney, Agent, or Firm*—Black Lowe & Graham PLLC

(57) ABSTRACT

An insert type of cylinder cabinet cam lock permits use of Schlage-compatible deadbolt cylinders in a cabinet door and/or drawer cam lock. A bifurcated, housing is provided that journals a cam driver adapted for operational interconnection with the Schlage-compatible standard deadbolt.

21 Claims, 2 Drawing Sheets

INSERT CYLINDER CABINET CAM LOCK

TECHNICAL FIELD

The invention relates to security devices for cabinet drawers and doors. More specifically, the invention relates to pin tumbler cam locks.

BACKGROUND OF THE INVENTION

There are two basic families of cabinet drawer and door locks: deadlocking and latch locking types of locks and cam-type locks. Both families of locks are used on cabinet drawers and doors such as those found on office desks, credenzas, and interior cabinetry. In the former family, an elongated bolt moves in a reciprocating manner into and out of a bolt housing between locked and unlocked positions, respectively, upon actuation of a key. In the latter family, an elongated bolt moves along an arcuate path, between locked and unlocked positions. In the cam family of locks, an angular rotation of 90 degrees is typically sufficient to determine the locked and unlocked positions.

Both families of locks may have their bolts actuated by either pin tumbler cylinder and plug assemblies, or disk tumbler-type assemblies. The disk tumbler-type assemblies are the least expensive and historically have been used in the cam type of lock. A lock of this type is shown in U.S. Pat. No. 3,863,476 to Patriquin in which a plurality of spring-loaded plates in a plug are biased to position a protrusion from the plates into an elongated trough or cavity in an externally threaded lock body. Interference between the protrusions and sidewalls of the lock body trough prevent rotation of the plug. Upon insertion of a key into a keyway of the plug, the plates retract and the protrusions are withdrawn from the trough. Thereupon, the plug can rotate within the threaded lock body. The plug is longitudinally restrained within the lock body by a spring-loaded clip. The bolt is typically journalled for rotation with and screwed onto a longitudinal extension at the rear of the plug. A cam lock of this type is considered a "direct drive" cam lock because the bolt is directly journalled for rotation with the plug. Stated another way, consider a cam lock of the type described in which the lock is received in a desk drawer, wherein the bolt at a 12 o'clock position interferes with a downwardly protruding sill or ledge in the desk. By inserting a key into the plug keyway the disk tumblers are retracted so as to be free of a trough in the externally threaded cylindrical body. Rotation of the key by 90 degrees to the 3 o'clock position clears the bolt of the desk so that the drawer may be opened. The externally threaded, cylindrical lock body may be provided with a pair of internal troughs angularly spaced at 90 degrees with respect to one another so that the key may be withdrawn while the bolt is in the unlocked, 3 o'clock position. Otherwise, to remove the key, the plug must be counterrotated back into the 12 o'clock position leaving the bolt in the "locked position" while the drawer is still open. This procedure has the undesirable consequence in that accidentally closing the open desk drawer with the bolt locked into the 12 o'clock position tends to mar the desk cabinetry. By positioning a second trough in the lock body cavity at the 3 o'clock position, this result can be avoided.

Over the years, it has become desirable to provide cam locks with a pin tumbler rather than a disk tumbler system. In the pin tumbler system, the disk plates are replaced with a series of cylindrical pins, which reside in bores in the plug. These "bottom pins" have differing lengths corresponding to ridges and valleys in a mating key. The lock body or cylinder is provided with a corresponding series of spring-loaded top pins, which can drop down into the bores in the plug into which the lower pins reside. When a key is inserted into the plug keyway, the top pins and bottom pins form a shear line at the interface of the plug and cylinder, allowing the plug to rotate freely. A particular problem with this type of lock is that the key can be inserted or removed only when the top and bottom pins are in alignment (typically the 12 o'clock position). A rekeyable pin tumbler cam lock of this type is shown in U.S. Pat. No. 5,038,589, issued to Martin and assigned to the predecessor in interest to the assignee herein. The disclosure of said patent is incorporated herein by reference. Thus, a cam lock adapted as a pin tumbler lock will suffer from the "damaged desk" syndrome discussed above unless a means is provided for rotating and locking the bolt in respective 12 o'clock and 3 o'clock positions, while permitting continued rotation of the key back to the 12 o'clock position.

For this purpose, the so called "lazy cam" has been developed in which the bolt of a pin tumbler type cam lock is free to rotate about a protrusion extending from a rearward surface of the plug. The lazy cam, however, is journalled for rotation with the plug and drives a pin or other protrusion on the bolt. An opposite side of the bolt is typically also provided with a forwardly extending pin that cooperates with laterally extending shoulders on the rear of the cylinder so as to limit rotation of the bolt through 90 degrees. The above-described structure permits the plug to rotate through 360 degrees while the bolt rotates through only 90 degrees, thus allowing the key to be removed while the bolt remains rotationally contained between the shoulder on the cylinder and a shoulder on the lazy cam. The desk drawer can now be opened and closed with the bolt in the unlocked position with the key removed.

The above-described lazy cam design provides the cam lock with all of the advantages of a pin tumbler design (e.g., ease in rekeying, possible master-keying with other cabinet drawer and door locks as well as entryway locks), which advantages are difficult to achieve or unattainable with disk tumbler-type locks. However, geometric realities prevent the bolt from being positionable anywhere other than the 12 o'clock and 3 o'clock positions described without changing the threaded cylinder body, so as to reposition the shoulders thereon that define the arcuate range of movement for the bolt. Alternate positioning for the bolt is desirable, as consumers have needs for cam locks having bolts that operate between the 12 o'clock and 3 o'clock positions; the 3 o'clock and 6 o'clock positions; the 6 o'clock and 9 o'clock positions; and the 9 o'clock and 12 o'clock positions as in drawer locks, left-hand door locks, tray locks, and right-hand door locks, respectively. A low-cost, rekeyable pin tumbler cam lock (ambidextrous) that addresses this problem is disclosed in U.S. Pat. No. 5,737,950 issued to Yun-Bin and assigned to the assignee herein. The disclosure of said patent is incorporated herein by reference.

Thus, there are now available pin tumbler cam locks having many attributes of entryway cam locks, such as rekeyability, master-keyability, ambidextrous design, etc. However, further integration between the world of pin tumbler cam locks and entryway locks is desirable, particularly in the institutional environment. By way of example, schools, hospitals, and the like frequently have deadlocking entryway doors to classrooms, laboratories, etc. Behind these entryway doors are cabinet doors and drawers for securing biological and chemical materials, pharmaceutical products, and, with respect to casinos and the like, cash drawers. The internal entryway doors of such institutional rooms are typically keyed with so-called standard deadbolt cylinders using spring-loaded pin tumbler designs. As is well known to those of ordinary skill in the art, Schlage manufactured a highly successful standard deadbolt cylinder in which the upper and lower spring-loaded tumbler pins are contained in a unitary body. A rear end of the cylinder is engageable with a driver bar (commonly known as a "tailpiece") that enabled the deadbolt cylinder to engage a variety of different entryway deadbolt mechanisms. Within the industry, this type of deadbolt cylinder became known by the acronym "SCDC" as a shorthand notation for "Schlage-Compatible Deadbolt Cylinder". U.S. Pat. No. 5,657,652, issued to Martin, entitled Pin Tumbler Cabinet Door and Drawer Deadlocking Latch Lock", demonstrates the adaptation of an SCDC (reference numeral 20 in FIG. 4 of said patent) used in conjunction with a deadlocking cabinet door and drawer latch lock. By utilizing identical Schlage-compatible deadbolt cylinders in both entryway doors and cabinet doors and drawers of institutional organizations, a synergistic efficiency is achieved, whereby a locksmith can create one key for a classroom, hospital laboratory, or the like and allow the occupant to use the same key to open the cabinet drawers and doors as well. Nevertheless, adaptation of a standard Schlage-compatible deadbolt cylinder to a cam type of lock in an economically viable design has heretofore eluded the industry.

Therefore, a need exists for an insert cylinder type cabinet cam lock that can utilize a standard Schlage-compatible deadbolt cylinder.

SUMMARY OF THE INVENTION

It is therefore an object of the present invention to provide an insert cylinder type of cabinet cam lock that can utilize a standard Schlage-compatible deadbolt cylinder.

It is a further object of the present invention to provide an insert cylinder type of cabinet cam lock that can utilize a standard Schlage-compatible deadbolt cylinder that achieves the above object and which also provides for an inexpensive method of manufacture.

It is yet another object of the present invention to provide an insert cylinder type of cabinet cam lock that can utilize a standard Schlage-compatible deadbolt cylinder that achieves the above objects and that is also readily rekeyable by a locksmith in the field.

The invention achieves the above objects, and other objects and advantages, which will become apparent from the description that follows, by providing an insert type of cylinder cabinet cam lock having a bifurcated case, consisting of an elongated cylinder housing portion and a mateable tailcap portion. The elongated cylinder housing defines an exposed front face having a keyway aperture for receipt of the keyway end of a standard Schlage-compatible deadbolt cylinder or the like. The elongated cylinder housing further defines a main body and a distal rear end, each adapted for removable rearward receipt of the conventional insert deadbolt cylinder. The tailcap portion forms an internal cavity having a rear wall defining a hub for journaling a cam driver for rotary motion with respect thereto. A front open end of the tailcap is adapted to be received on the rear end of the cylinder housing. A specially designed cam driver has a forward end adapted for cooperative receipt in the rear end of the conventional insert type of deadbolt cylinder and a distal end adapted to receive and drive (indirectly) a conventional cam bolt. The distal end of the cam driver passes through the tailcap hub so that the cam bolt is removably journalled to the cam driver external to the bifurcated cam lock case. A threaded pin or the like may be used to secure the tailcap to the cylinder housing and also to limit rotation of the cam bolt to a prescribed range.

In preferred embodiments of the invention, a conventional lazy cam may be journal led to the cam driver and operatively connected with the cam bolt so as to drive the cam bolt in the conventional manner.

In alternate embodiments of the invention, the insert type of cylinder cabinet cam lock is usable with large format-interchangeable cores, such as those manufactured by Schlage. In this embodiment, a cam driver having a different front end design is used having transverse rebates on the front end thereof for receipt of a conventional (but shortened) driver bar (or tailpiece).

In either embodiment of the invention, both the cylinder housing and tailcap have at least partially, substantially continuous cylindrical surfaces with synchronized external threads thereon for receipt of a conventional, cooperatively threaded nut to secure the lock case to a cabinet door or drawer. In addition, the externally threaded cam lock may also be received in a conventional threaded receptacle for an entryway deadbolt so as to convert such an entryway to a cam locking entryway door.

DETAILED DESCRIPTION OF THE PREFERRED EMBODIMENTS

Figure 1:
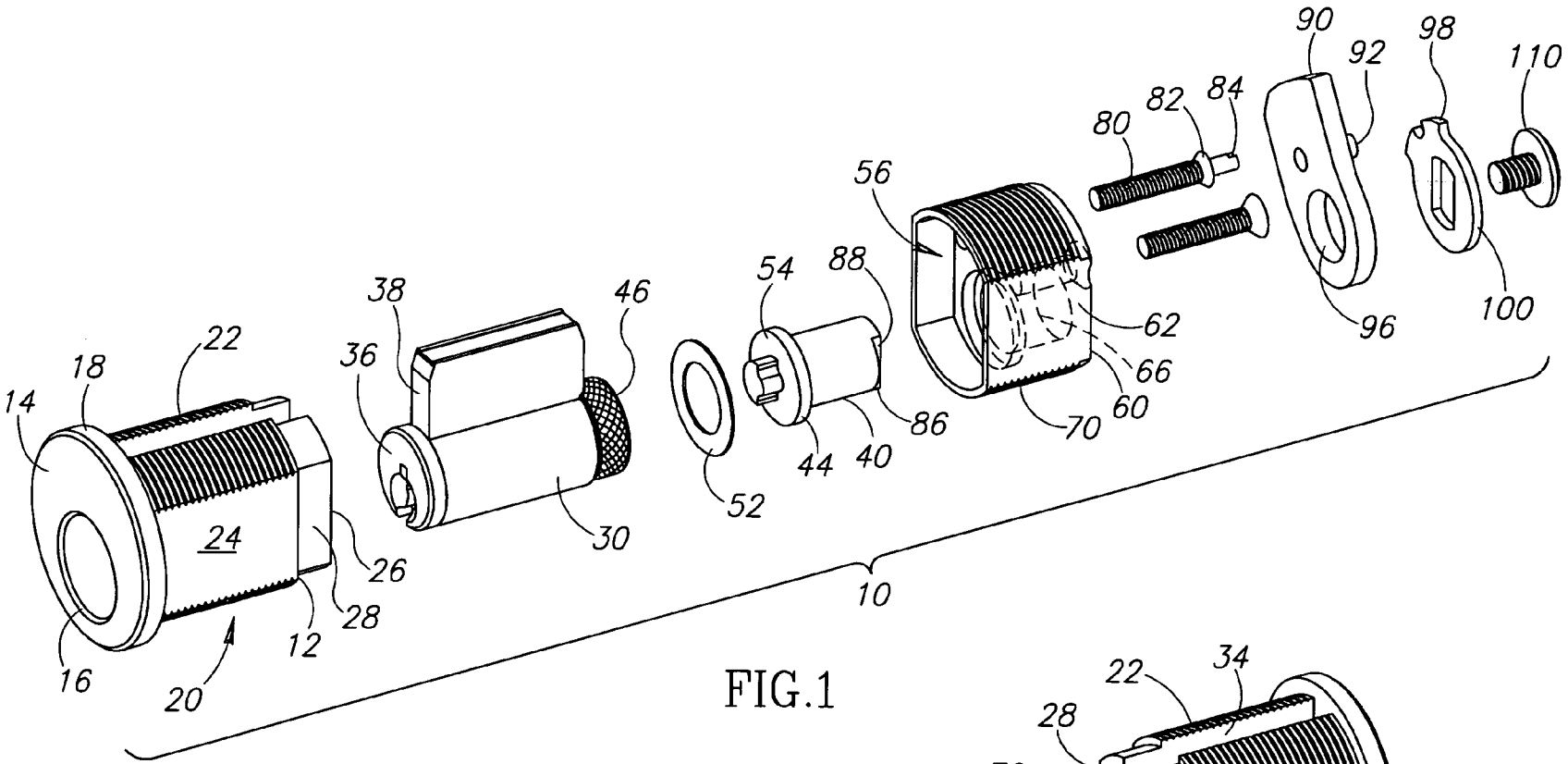
FIG. 1 is an exploded, top right perspective view of an insert type of cylinder cabinet cam lock in accordance with the principles of the invention.

An insert type of cylinder cabinet cam lock in accordance with the principles of the invention is generally indicated at reference numeral 10 in the various Figures of the attached drawings wherein numbered elements in the Figures correspond to like numbered elements herein.

Figure 2:
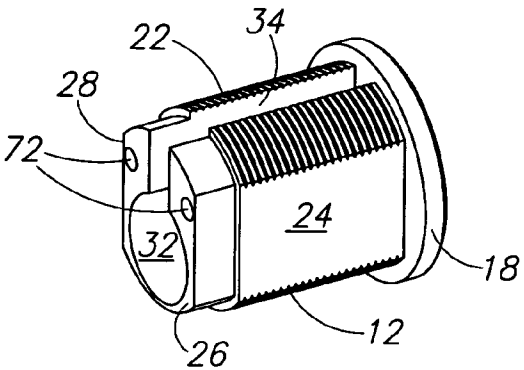
FIG. 2 is a top left rear perspective view of the elongated cylinder housing shown in FIG. 1.

The cam lock is substantially bifurcated as will be explained further herein below and includes an elongated cylinder housing 12 having a front face 14 defining a keyway aperture 16 and a circumferential rim 18 extending beyond a main body, generally indicated at reference numeral 20 in FIG. 1. The main body is generally cylindrical in shape, having external threads 22 on cylindrical portion thereof and generally flat, non-threaded sidewalls 24, as best seen in FIG. 2. As will be understood by those of ordinary skill in the art, the external threads 22 on the generally cylindrical portions of the main body are adapted to receive a conventional nut for securing the main body to a cabinet door or drawer or, alternatively, into the standard, threaded receptacle of an entryway door deadlock. The main body further includes a distal rear end 26 defining a substantially radially inward rebate generally circumferentially around the entire rear end 26. The main body 20 and rear end 26 are adapted to rearwardly receive a conventional insert-type deadbolt cylinder 30 through a rear aperture 32 and an intersecting vertical slot 34. A cylindrical bore extends from the rear aperture 32 through the keyway aperture 16, such that a keyway face 36 of the deadbolt cylinder 30 is received substantially flush with the front face 14 of the main body 20 in the conventional manner, while the vertical slot 34 receives an upper pin housing 38 of the deadbolt cylinder 30 in the conventional manner. The main body 20 is preferably manufactured from a die-cast alloy, such as zinc, or may be machined from brass or steel.

Figure 3:
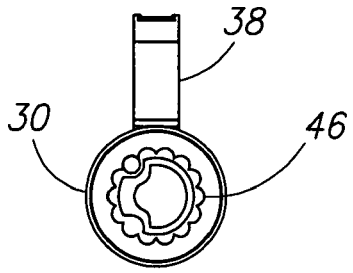
FIG. 3 is a rear elevational view of a conventional Schlage-compatible deadbolt cylinder shown in FIG. 1.
Figure 4:
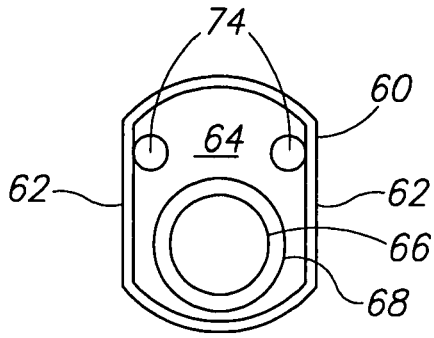
FIG. 4 is a front elevational view of the tailcap shown in FIG. 1.
Figure 6:
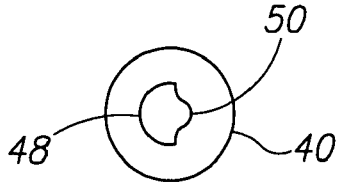
FIG. 6 is a front elevational view of the cam driver shown in FIG. 1.

A substantially cylindrical cam driver 40 has a forward end 44 adapted for cooperative engagement with a rear end 46 of the deadbolt cylinder 30, as best seen in FIG. 3. As best seen in FIG. 6, the adaptation includes a hemicylindrical axial protrusion 48, including a central bulge 50 for mating with the rear end 46 of the deadbolt cylinder 30. A low-friction spacer or washer 52 is preferably interposed between the cam driver 40 and the rear end 46 of the deadbolt cylinder 30. The cam driver 40 is also provided with a radially extending, circumferential flange 54 on the forward end 44, to support the washer 52, and for other purposes, as will be described further hereinbelow.

The cam driver 40 is contained in a cavity generally indicated at reference numeral 56 in a tailcap 60 having an external profile substantially identical to that of the main body 20 of the cylinder housing 12. The cavity is defined by substantially vertical sidewalls 62, and by a substantially planar rear wall 64 defining a cam driver hub or aperture 66 in a lower portion thereof. The hub 66 forms a journal for the cam driver 40 for rotation. A circumferential groove 68 about the hub 66 forms an axial bearing surface for the flange 54 on the cam driver 40. Sidewalls 62 of the tail cap 60 are sized to fit closely about the rebate 28 on the main body rear end 26 such that the cam driver 40 and washer 52 are substantially contained within the cavity 56, and the main body 20 and tailcap 60 form a substantially continuous external surface. In this way, external threads 70 on the tail cap 60 cooperate with the external threads 22 of the main body for application of a cooperatively threaded nut (not shown), as previously described. In order to retain the tailcap 60 on the cylinder housing 12, the rear end 26 of the cylinder housing 12 is provided with a pair of longitudinal, threaded bores 72 and the tailcap 60 is provided with a pair of corresponding apertures 74 in the rear wall 64 of the tailcap. As best seen in FIG. 1, a threaded pin 80 having a circumferential shoulder 82 and a rearwardly extending portion 84 may be inserted through either aperture 74 and into a corresponding one of the threaded bores 72 such that the shoulder 82 urges against an external surface of the rear wall to retain the tailpiece 60 with respect to the cylinder housing 12.

Figure 5:
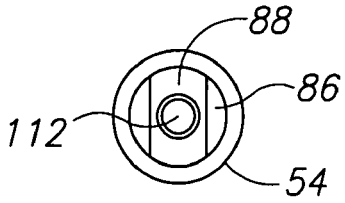
FIG. 5 is rear elevational view of the cam driver shown in FIG. 1.

As will be appreciated by those of ordinary skill in the art, the cam driver 40 has a distal end 86 that protrudes from the cam driver hub 66 when the lock 10 is assembled. The distal end is provided with a conventional tenon 88 that axially, rearwardly protrudes from both the cam driver distal end 86 and the rear wall 64 of the tailpiece 60, along with a further portion of the cam driver 40, such that the conventional cam bolt 90, having a conventional transverse pin 92 and cam bolt aperture 96, may be freely received on the extending portion of the cam driver 40 so as to rotate thereabout. A conventional lazy cam 98 has a conventional mortise 100 for journaling the lazy cam with the tenon 88 so that the lazy cam is journaled to and rotates with the cam driver 40. The transverse pin 92 on the cam bolt 90 may be engaged with the lazy cam, as is well known by those of ordinary skill in the art, so as to be either a direct drive or indirect drive. As best seen in FIGS. 1 and 5, a conventional screw 110 secures the lazy cam 98 and cam bolt 90 to the cam driver 40 by way of a conventional threaded hole 112 in the distal end 86 of the cam driver 40.

As will be appreciated by those of ordinary skill in the art, the cam lock 10 shown in the illustrated Figures permits a conventional insert type of deadbolt cylinder 30 to be utilized in a cam lock environment. In this way, the same key that is utilized for an entryway deadbolt, utilizing the insert type of deadbolt cylinder 30, can also be used to operate the cam lock 10, which has been keyed with an identical type of deadbolt cylinder, as is the entryway door. As a result, a hospital or pharmacy entryway door can be keyed alike with cabinet doors and drawers employing the inventive cam lock 10, as well as retractable-style cabinet drawer and door locks also employing the insert type of deadbolt cylinder 30, such as that shown at reference numeral 20 in U.S. Pat. No. 5,657,652, issued to Martin on Aug. 19, 1997, the disclosure of which is incorporated herein by reference.

Figure 7:
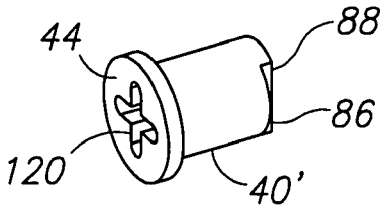
FIG. 7 is top left rear isometric view of an alternate embodiment of the cam driver shown in FIG. 1.
Figure 8:
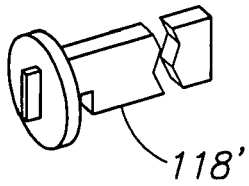
FIG. 8 is a top left perspective view of a driver bar for use with the alternate embodiments of FIG. 7.

Those of ordinary skill in the art will conceive of other alternate embodiments of the invention upon reviewing this disclosure. In one alternate embodiment shown in FIG. 7, the cam driver 40 of the above embodiment is replaced with an alternate cam driver 40 for use with a conventional blade like driver bar such as shown at reference numeral 188' in FIG. 8. In the alternate end 44' of the cam driver 40' may be provided with orthogonal rebates 120 to receive the bladelike driver bar (not shown) described above. In all other respects, the remaining elements of the alternate cam driver 40' are similar to those shown at reference numeral 40 of the first preferred embodiment. Thus, the invention is not to be limited to the above description, but is to be determined in scope by the claims that follow.

I claim:

1. An insert cylinder cabinet cam lock, comprising:

an elongated cylinder housing defining an exposed front end keyway aperture, a main body, and a distal rear end adapted for removable receipt of a conventional insert deadbolt cylinder;

a substantially cylindrical cam driver having a forward end adapted for cooperative receipt in the deadbolt cylinder and a distal end adapted to receive and drive a cam bolt;

a tailcap having spaced-apart sidewalls defining an open front end and an internal cavity adapted to mate with the cylinder housing rear end, and a planar rear wall defining a hub for journaling the cam driver for rotary motion;

a cam bolt removably journalled to the cam driver for rotation therewith; and, removeable cam bolt rotary limitation means for securing the tailcap to the cylinder housing and for limiting rotation of the cam bolt thorough a prescribed range.

2. The cam lock of claim 1, wherein the cylinder housing rear end has a circumferential rebate and the tailcap has a corresponding circumferential flange sized for receipt on the rebate so that the cylinder housing and tailcap have a substantially continuous surface on at least a portion thereof and synchronized external threads on the continuous surface.

3. The cam lock of claim 1, wherein the cylinder housing has a plurality of axial treaded bores in the rear end thereof for alternate receipt of the cam bolt rotary limitation means and the tailcap rear wall defines corresponding apertures in registration therewith for passage therethrough of the cam bolt rotary limitation means.

4. The cam lock of claim 3, wherein the cam bolt rotary limitation means is a pin having a cooperatively threaded portion for receipt in one of the threaded bores and a circumferential shoulder for urging against the tailcap rear wall.

5. The cam lock of claim 1, wherein the cam driver has a radially extending circumferential flange for axially rearwardly restraining the cam driver.

6. The cam lock of claim 5, wherein the tailcap has a circumferential groove about the cam hub for bearing the cam driver flange.

7. The cam lock of claim 1, wherein the cam driver forward end has a hemicylindrical axial protrusion including a central bulge adapted for receipt in the deadbolt cylinder.

8. The cam lock of claim 7, including a low-friction washer positioned about the cam driver axial protrusion and between the cam driver flange and the deadbolt cylinder.

9. The cam lock of claim 1, including a lazy cam driver journaled for rotation with the cam driver rear end and having cam bolt drive means for driving the cam bolt.

10. The cam lock of claim 9, wherein the bolt includes a transverse pin for cooperative engagement with the lazy cam bolt drive means.

11. An insert cylinder cabinet cam lock, comprising:

a cylinder housing defining an exposed front end keyway aperture, a main body, and a distal rear end adapted for removable receipt of an insert deadbolt cylinder;

a cam driver having a forward end adapted for cooperative receipt in the deadbolt cylinder and a distal end adapted to receive and drive a cam bolt;

a tailcap having spaced-apart sidewalls defining an internal cavity adapted to mate with the cylinder housing rear end, and a rear wall defining a hub for journaling the cam driver for rotary motion;

a cam bolt removably journalled to the cam driver for rotation therewith; and, cam bolt rotary limitation means for securing the tailcap to the cylinder housing and for limiting rotation of the cam bolt through a prescribed range.

12. The cam lock of claim 11, wherein the cylinder housing rear end has a circumferential rebate and the tailcap has a corresponding circumferential flange sized for receipt on the rebate so that the cylinder housing and tailcap have a substantially continuous surface on at least a portion thereof and synchronized external threads on the continuous surface.

13. The cam lock of claim 11, wherein the cylinder housing has an axial treaded bore in the rear end thereof for receipt of the cam bolt rotary limitation means and the tailcap rear wall defines a corresponding aperture in registration therewith for passage of the cam bolt rotary limitation means.

14. The cam lock of claim 13, wherein the cam bolt rotary limitation means is a pin having a cooperatively threaded portion for receipt in the threaded bore and a circumferential shoulder for urging against the tailcap rear wall.

15. The cam lock of claim 11, wherein the cam driver has a circumferential flange for axially restraining the cam driver.

16. The cam lock of claim 15, wherein the tailcap has a circumferential groove about the cam hub for bearing the cam driver flange.

17. The cam lock of claim 11, wherein the cam driver forward end has a hemicylindrical axial protrusion adapted for receipt in the deadbolt cylinder.

18. The cam lock of claim 17, including a low-friction washer positioned about the cam driver axial protrusion and between the cam driver flange and the deadbolt cylinder.

19. The cam lock of claim 11, including a lazy cam driver journalled for rotation with the cam driver rear end and having drive means for driving the cam bolt.

20. The cam lock of claim 19, wherein the bolt includes a transverse pin for cooperative engagement with the lazy cam drive means.

21. An insert cylinder cabinet cam lock, comprising:

an elongated cylinder housing defining an exposed front end aperture, a main body, and a distal rear end, the cylinder housing being adapted for removable receipt of a conventional insert deadbolt cylinder;

a substantially cylindrical cam driver having a forward end adapted for cooperation with the deadbolt cylinder and a distal end adapted to receive and drive a cam bolt;

a tailcap defining an open front end and an internal cavity adapted to mate with the cylinder housing rear end, and a planar rear wall defining a hub for journaling the cam driver for rotary motion;

a cam bolt removably journalled to the cam driver for rotation therewith; and, a removeable cam bolt limiter for limiting rotation of the cam bolt thorough a prescribed range.

* * * * *

UNITED STATES PATENT AND TRADEMARK OFFICE

CERTIFICATE OF CORRECTION

PATENT NO. : 7,716,958 B2
APPLICATION NO. : 11/811262
DATED : May 18, 2010
INVENTOR(S) : Frank J. Martin It is certified that error appears in the above-identified patent and that said Letters Patent is hereby corrected as shown below:

Col. 6, line 51, delete the word "thorough" and substitute therefor --through--.

Col. 8, line 40, delete the word "thorough" and substitute therefor --through--.

Signed and Sealed this

Tenth Day of August, 2010

David J. Kappos

David J. Kappos
*Director of the United States Patent and Trademark Office*